United States Patent [19]

Podrini

[11] Patent Number: 4,769,114

[45] Date of Patent: Sep. 6, 1988

[54] PROCESS AND DEVICE FOR CONTINUOUS ELECTROLYTIC TREATMENT OF METALS

[75] Inventor: Maurizio Podrini, Rome, Italy

[73] Assignee: Centro Sviluppo Materiali S.p.A., Rome, Italy

[21] Appl. No.: 132,315

[22] Filed: Dec. 14, 1987

[30] Foreign Application Priority Data

Dec. 18, 1986 [IT] Italy ..... 48761 A/86

[51] Int. Cl.[4] ..... C25D 7/06; C25D 17/00

[52] U.S. Cl. ..... 204/28; 204/206

[58] Field of Search ..... 204/28, 206

[56] References Cited

U.S. PATENT DOCUMENTS 2,673,836 3/1954 Vonada ..... 204/28

*Primary Examiner*—T. M. Tufariello

*Attorney, Agent, or Firm*—Young & Thompson

[57] ABSTRACT

Process for continuous electrolytic treatment of metals which employs treatment units comprising pairs of vertical cells characterized by the fact that the electrolyte is moved in a controlled manner and in such a way as to ensure the desired electrolyte flow-rate values and constancy of such values in each cell employed for said treatment.

25 Claims, 1 Drawing Sheet

PROCESS AND DEVICE FOR CONTINUOUS ELECTROLYTIC TREATMENT OF METALS

Figure 1:
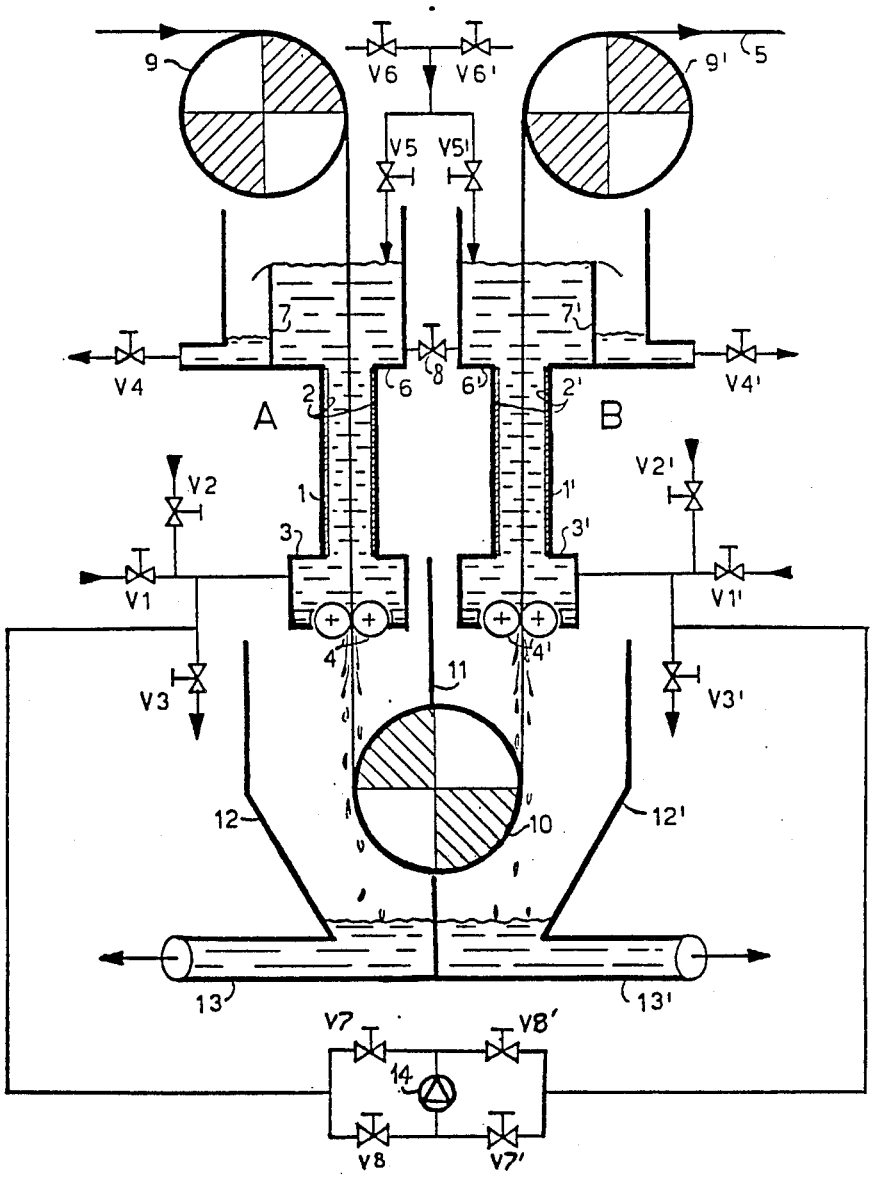

The present invention relates to a process and a device for the continuous electrolytic treatment of metals. More precisely it relates to a process which utilizes vertical cells in which the electrolyte is moved in such a way as to ensure the desired electrolyte flow-rate values and constancy of such values within each of the electrolytic cells employed for the treatment.

It is known that electrolytic metal deposition treatments are processes in which a great number of variables such as temperature, composition and pH of the electrolytic solution, current density employed, and geometry of the electrolytic treatment cell play an important role in establishing the plating process yield and the quality of the deposit, as described in Italian Patent Application No. 48371A/85 filed by the same applicant.

In particular, a fixed relationship must be maintained between current density and the fluid dynamics conditions of the electrolyte, especially in electrolytic processes that employ high current densities, so as to obtain high-quality deposits.

However, industry really still lacks processes and devices that can ensure this relationship and manufacture products of consistently high quality, especially when the electrolytic processes in question are carried on at high current density.

Devices for the continuous electrolytic treatment of metals are known, for instance the one described in U.S. Pat. No. 2,673,836. Yet these devices are not satisfactory, since on one cell the electrolyte encounters the metallic body in countercurrent flow and in the other in parallel flow, so the essential condition of constant relative velocity between metal body and electrolyte is not attained. Consequently, with such devices electrolytic treatments calling for identical fluid dynamics conditions in each of the treatment cells are not possible. A further drawback with such devices is that the lower deflection roll cannot be used for carrying current because it is immersed in the electrolyte.

Because of the ever-greater need to develop continuous electrolytic treatment of metal bodies involving high line speeds (200 m/minute or more) with high installed currents (around 80.000 Amps per unit) and high current densities (around 200 A/dm$^2$) it is considered particularly advantageous to be able to conduct current also via the lower deflection roll so as to halve the resistance offered by the metal body to be treated and thus double the installed current for each unit and hence for the whole of the treatment line.

Various devices for the continuous electrolytic treatment of metal bodies have been successively developed (Italian Patent Application No. 47663A/85, by the same applicant). These include vertical electrolytic cells in which fluid dynamics conditions in each electrolytic cell can be kept constant and equal. However, even with these devices current cannot be fed through the lower deflection roll because here, too, it is immersed in the electrolyte. Furthermore, with such devices electrolyte flows cannot be controlled and differentiated in each cell. Indeed, with the cell arrangement described, once the flows have been set the electrolyte is moved in such a way that a present flow-rate for the first cell corresponds to the flow-rate for the other cell in the opposite direction, this being the sole way to obtain the same fluid dynamics conditions in each cell.

Consequently it was needed to develop a process for continuous electrolytic treatment of metal bodies, and a device with vertical cells to embody the process, such as to provide perfect control of the desired fluid dynamics conditions in each of the electrolytic cells employed; namely, such as to ensure that the electrolyte, moved simply by means of valves, flow meters, pumps and perhaps other per se known flow regulators, should guarantee the appropriate fluid dynamics conditions for the type of treatment to be performed and also for the movement conditions of the metal body to be treated.

It was also necessary that the device conceived should ensure that the lower deflection roll was not immersed in electrolyte thus eliminating the electrical continuity between the anode and said roll, so that it could be utilized to carry current. A process and a device for continuous electrolytic treatment of metal bodies have been developed which permit attainment of the foregoing. In this context the term metal bodies covers all those thin, continuous metal bodies that can be deflected in movement such as strip or wire for example.

The present invention, therefore refers to a process for the continuous electrolytic treatment of metal bodies which employs vertical cells in which the electrolyte is moved in such a way as to ensure control of fluid dynamics conditions in each of the cells employed for said treatment, where the term control of fluid dynamics conditions means the attainment of the desired electrolytic flow-rate values and constancy of these values in each cell, it being implied that these desired given flow-rates can be the same or different in each cell, depending on the type of electrolytic treatment to be performed and on the operating conditions, such as, for instance, the speed of travel of the metal body to be continuously treated and the current density. The present invention also refers to a device for the continuous treatment of metal bodies including at least one electrolytic treatment unit comprising pairs of vertical electrolytic cells, such as to permit movement of the electrolyte so as to attain said control and constancy of fluid dynamics conditions.

According to this invention the process for the continuous electrolytic treatment of metal bodies which ensures control and constancy of fluid dynamics conditions throughout the entire process includes the following ensemble of operations in cooperation:

passing the metal body to be treated through at least one treatment unit, said unit including a first and a second adjacent, identical vertical electrolytic cells each with a vertical conduit within whose walls are housed electrodes and each with an upper and a lower distribution chamber; said metal body being deflected downwards by an upper conductor roll, passing vertically downwards through the first cell and being then deflected upwards by a lower conductor roll and passing upwardly the rough said second cell where it is again deflected by an upper conductor roll, none of the conductor rolls being immersed in the electrolyte; said vertical cells terminating above said lower roll with seals housed in each chamber, such as to permit passage of the metal body as well as of a leakby flow;

ensuring a controllable flow-rate of electrolyte in each cell by feeding a main known stream and the same time introducing additional known streams to compensate for electrolyte lost by leakby, thus maintaining the electrolyte level constant in each upper chamber;

applying a difference of potentials between the metal body to be treated and the electrodes.

Cell geometry can be varied to suit the geometry of the metal bodies to be treated. If, for instance, the metal body has a round section, then the conduits also have a round section. If, instead, a metal strip is involved, the cells will be built preferably with a rectangular section and the electrodes will be housed in the two walls of said conduits parallel to the faces of the strip to be treated. Movement of the electrolyte as per this invention can be achieved in various ways depending on whether the stream of known flow-rate is fed to the cells from below through the lower distribution chamber or from above through the upper distribution chamber.

Hence if the main electrolyte stream of known flow-rate is fed into the lower expansion chamber of the first cell, at the same time an additional electrolyte flow is fed into said chamber to make good the flows lost via leakby through the seals, said losses being appropriately measured.

The electrolyte is forced to pass through said chamber and travels up the vertical conduit of the first cell into the corresponding upper chamber, which is in communication with the upper chamber of the second cell. Said electrolyte then gravitiates down the vertical conduit of the second cell to reach the corresponding lower chamber from which part is lost as leakby and part flows out via a specific outlet. At the same time the upper chamber is fed by a further additional stream of electrolyte at a known flow-rate so that a constant electrolyte level is maintained there, by means of a adjustable weir, for instance. Consequently the total of streams of known flow-rate entering via the upper chambers, less the known flow-rate which leaves via one of the weirs determines the electrolyte flow-rate in the second cell.

In the particular case when the flow-rate leaving via the weir is equal to the additional flow-rate then the flow-rates in the two cells of the treatment unit are the same, being imposed by the main stream of known flow-rate fed into the lower chamber of the first cell.

In the case when the main stream of known flow-rate is fed into the upper expansion chamber of the first cell, the electrolyte is forced to pass through the vertical conduit of the first cell in a downwards direction and then through the vertical conduit of the second cell in an upwards direction, the movement being ensured by means of a pump which transfers the electrolyte from the lower chamber of said first cell to the lower chamber of the second. Electrolyte which passes through the seals as leakby—being entrained by the metal body—runs out these chambers as a measured flow. At the same time an additional measured flow of electrolyte is fed into the lower chamber of the second cell to make good the leakby flows. In addition, a further measured flow of electrolyte is fed into the upper chamber of the first cell in such a manner that, for instance, by means of an adjustable weir the level of liquid there is kept constant, as desired.

In general it will occur that the total of known flow-rates entering the upper chamber, less the known flow-rate over the weir will determine the electrolyte flow-rate in the cell with the downward directed stream.

In particular, when the flow-rate from the weir is equal to the flow-rate of said further additional stream, all the main stream of known flow-rate is fed into the first cell and there is equal flow-rate through the two cells of the treatment unit. When it is wished to achieve independent streams of electrolyte in each cell of the treatment unit, each of said cells can be fed separately either via the upper chamber or via the lower one in the ways described earlier.

Valves servo-controlled by appropriate flow-meters and other regulation and measuring systems already known to technicians in this branch, possibly with the aid of auxiliary known means such as enjectors, ejectors and other useful devices to suit operating condition choices and the type of electrolyte, are all employed for movement of the electrolyte in the desired direction at the required flow-rate in the two cells of each treatment unit.

Flows leaking throught the seal systems are not only inevitable because the seals must permit the passage of the metal body, they are also necessary since they play an important role in wetting the metal body. When said metal body is deflected by a lower roll not immersed in the electrolyte, as in the present invention, it must necessarily be wetted by the electrolyte so that the passage of current through it does not cause electric arcing which could even result in serious damage when said lower roll is used as a current conductor.

The device according to this invention which permits the movement of the electrolyte, such as that described above, for example, comprises at least one treatment unit consisting of two identical vertical electrolytic cells.

In each unit the metal body to be treated continuously is deflected by an upper conductor roll, passes vertically downwards through a first cell, is deflected upwards by a lower conductor roll and passes through the second cell from bottom to top where it is deflected by another upper conductor roll, no conductor roll being immersed in the electrolyte.

Each electrolytic cell has a vertical conduit in the sides of which are housed the electrodes, said conduit having an upper and a lower expansion chamber the latter terminating above the lower conductor roll and seals that permit the passage of the metal body to be treated.

The upper distribution chambers of each unit are preferably interconnected by means of a valve, while the lower chambers are interconnected by means of a pump.

A preferred embodiment of the upper chambers is that of open construction so they can be fitted with adjustable overflow weirs.

In a preferred embodiment a single upper expansion chamber is provided which is common to the two cells of the unit when the same electrolyte that flows upwards in one cell passes into the second with a downwards flow through said upper common chamber.

Each unit has collection tanks and systems to meter the leakby flows, as well as cooperating means for the control and reversal of electrolyte flows in each cell forming the treatment unit. Such cooperating means comprise valves for the regulation of the electrolyte flow-rates, pumps and flow meters.

Each of the treatment units according to the invention is such as to permit the feed of electrolyte to the lower chamber or the upper chamber of each cell forming said units. Moreover it permits, at well, either to feed the same electrolyte stream from the first to the second cell to independently feed each cell forming the treatment unit.

By means of said feeds it is thus possible, for instance, to have constant and equal streams in each cell, or, alternately to have controlled but diverse streams in each of them, since the device can ensure the desired electrolyte flow-rates and the constancy thereof in each cell. In fact, simply by means of known devices to move the electrolyte in or out each cell and merely by actuating valves and pumps, the flow-rate and direction of movement of the electrolyte can be controlled so as to adapt them to the movement conditions of the metal body to be treated, to the current density employed and to the type of electrolytic treatment to be given, so as to optimize product quality.

Moreover, as the two cells of the treatment unit are the same, the electrolyte flows can be reserved in relation to a predetermined direction of movement of the metal body to be treated. Hence with the device according to the invention a wide range of relative velocities between electrolyte and metal body can be achieved. The device also permits current to be fed through the lower deflection roll, because elimination of the electrolyte eliminates electrical continuity between the anodes and the roll, as explained above.

Merely by way of example the invention is now explained by reference to an embodiment of a treatment unit as schematized in FIG. 1.

The unit in FIG. 1 consists of two cells, A and B, for electrolytic treatment. These cells are identical, consisting of vertical conduits 1 and 1' with electrodes 2 and 2' housed in the walls. Each cell terminates in an upper distribution chamber 6 and 6' and a lower chamber 3 and 3' equipped with means for the inflow and outflow of the electrolyte. In said lower chambers which are interconnected by pump 14, seal systems are housed for the electrolyte 4 and 4' which permit the passage of the metal body 5 to be treated. The loss of electrolyte through the seals as leakby must be expected. Adjustable overflow weirs 7 and 7' are provided in the upper distribution chambers 6 and 6' which are in communication via valve 8. Metal body 5 is made to run downwards through cell A and upwards through cell B, its direction being imposed by upper rolls 9 and 9' and lower roll 10. As none of these rolls is immersed in the electrolyte they can all be used as conductors. There is a lower collection tank divided into two parts by a watertight divisor 11, thus creating two chambers 12 and 12' which have bottom outlets 13 and 13'. These chambers separately collect the electrolyte coming from each cell. Provision is made for valves V1 to V8 and V1' to V8' as well as for valve 8 for regulating electrolyte flow-rate. Pump 14, with associated flow regulation and reversal circuit, connects the two lower chambers 3 and 3'.

Various examples in which the cell schematized in FIG. 1 is used for different electrolyte flow schemes are described below.

FEED VIA LOWER CHAMBER

An electrolyte stream of known flow rate $Q_A$ is fed via valve V1 into distribution chamber 3 from where some is lost by leakby through seal systems 4 and collects in chamber 12, the amount involved being measured at outlet 13. At the same time an additional stream of electrolyte of flow-rate $Q_{ADD1}$ is fed to said chamber via valve V2 to make good the leakby losses. In this manner $Q_A$ is the flow rate which actually flows in conduit 1. Hence stream of flow-rate $Q_A$ is forced to pass from chamber 3, through the vertical conduit 1 of cell A into the upper distribution chamber 6 where it passes through valve 8, that is normally open, into chamber 6' feeding cell B, flowing down to lower chamber 3' from which part is lost be leakby through the seal system 4' and part flows out through control valve V3'. At the same time an additional stream of flow rate $Q_{ADD2}$ is fed through valve V6'—valves V4' and V5' being open while V4, V5 and V6 are closed—into distribution chamber 6' so that the electrolyte level is kept constant in the two chambers 6 and 6' by means of weir 7'.

To ensure that $Q_A$ is the same as $Q_B$, since $Q_A$ is known and $Q_B$ is the electrolyte's flow-rate in conduit 1' of cell B, it is necessary to ensure that the additional known flow rate $Q_{ADD2}$ if equal to the flow over the weir; this equality of flows is maintained by regulating outlet valve V3'.

Because of the perfect symmetry of the device, it is possible to reverse the electrolyte feed from chamber 3 to chamber 3', as is evident from FIG. 1. Thus flow can be obtained in the same direction as the direction of travel of the metal body to be treated or in the opposite direction thereto, providing the widest possible range of relative velocities between electrolyte and metal body.

FEED VIA UPPER CHAMBER

An electrolyte stream of known flow-rate $Q+_A$ is fed into the upper expansion chamber 6 via valve V6 and is forced to pass down the vertical conduit 1 of cell A by means of pump 14 which transfers the electrolyte from the lower chamber 3 to 3', valves V8 and V8' being open while valves V7, V7', V1, V2, V3, V3' and V1' are closed. From lower chamber 3' the electrolyte is forced into vertical conduit 1' where it reaches upper chamber 6' from where it spills over weir 7' and flows out via valve V4'. In lower chambers 3 and 3' there is leakby of electrolyte via seal systems 4 and 4' through which passes the metal body for treatment 5. The leakby flows are collected in chambers 12 and 12' and are metered at outlets 13 and 13'.

At the same time an additional electrolyte stream of flow-rate $Q+_{ADD1}$ which is the same as the sum of the leakby flows is fed into the lower chamber 3' through valve V2' thus ensuring that flows in conduits 1 and 1' are equal. Furthermore, an additional flow of $Q+_{ADD2}$ is fed into the upper chamber 6 through valve V6' so that the level is kept constant there by weir 7. When the flow over the weir is equal to additional flow $Q+_{ADD2}$ all the fed flow $Q+_A$ flows in cell A and B. Since the device is perfectly symmetrical, electrolyte flow can be reversed so that it flows from cell B to cell A, by feeding upper tank 6' and reversing the pump 14 by opening valves V7 and V7' and closing valves V8 and V8', as is evident from FIG. 1. It is thus possible to obtain flows in the same direction as the metal body to be treated or in the opposite direction thereto, providing the widest possible range of relative velocities between electrolyte and metal body.

So far descriptions have been given of flow patterns of the same electrolyte from one cell to the other in the same unit. To cope with special requirements, each cell can be fed with different electrolyte flows by closing valves 8, V7, V7', V8, and V8'.

INDEPENDENT FEED OF THE TWO CELLS (a) Feed via lower chamber

Cell A is fed from the bottom via valve V1 and lower chamber 3, part of the electrolyte flow being lost as leakby through seal systems 4, while part is forced to pass up through conduit 1 to the upper chamber 6, overflowing via weir 7 and passing through valve V4 as a metered flow; this is the flow that actually travels through conduit 1.

Because of the perfect symmetry of the device, the functions described for cell A are identical with those for cell B.

(b) Feed via upper chamber

Cell A is fed with a known electrolyte flow-rate $Q^*_A$ via valve V6 and the upper chamber. The electrolyte flows from weir 7 to valve V4. By opening valve V3 the electrolyte is forced to pass into conduit 1 and its flow-rate is determined by the difference between the incoming rate from V6 and the one out valve V4. Since the device is perfectly symmetrical the functions described for cell A are identical with those for cell B.

As is evident from the foregoing regarding independent feed, with the device described and illustrated in FIG. 1 it is possible to feed cell A from the bottom and cell B from the top at the same time, or vice versa, achieving flows parallel to or countercurrent to the metal body to be treated. Or it is also possible to feed both cells A and B from the bottom or from the top. The flow rates in each cell can be the same or different, being selected in accordance with the current density employed in each cell, or anyway in relation to the requirements of the treatment to be performed.

With the process and device according to the invention it is possible to achieve different electrolytic treatments on the same line, for instance, deposition of metals and/or alloys on substrates to be treated, pickling or other treatments, thus providing great flexibility and versatility on plants employing the device as per the invention. In particular, electrolytic deposition of zinc and/or alloys thereof can be advantageously effected.

It is evident, therefore, that according to this invention, merely by altering the operating setting of a few valves and pumps, any electrolytic flow condition that may be desired and/or necessary in the cells can be achieved, permitting electrolytic treatment to be conducted in the best manner. The device according to the invention, moreover, can be applied not only on conventional production lines but also on those employing high current densities—even of the order of 200 A/dm$^2$ and higher—which also use high currents for each treatment unit, even of as much as 80.000 Amps and over, with the metal body to be treated travelling at speeds of 200 m/min or above.

Types of electrodes that can be used in the electrolytic cells for treatments to be performed with the process as per the invention can be either soluble or insoluble anodes, arranged as one or a number of elements along two facing walls of the cells.

One advantage of the invention is that as the metal body to be treated is accompanied by deflection rolls, these rolls are not immersed in the electrolytic solution so they can all be utilized as current conductors, thus halving the electrical resistance offered by the metal body. As the number of conductor rolls is doubled the current installed on the treatment line can also be doubled. This is particularly advantageous, for instance, in the special case of metal strip electroplating processes, because the same plant productivity can be maintained with both one-side and two-side coating, the weight of the electrolytic deposit being doubled without any plant shutdown. Another advantage of the invention is the fact that the plants utilizing the process, the device as per the invention and the electrolytic fluid flow-paths described are easy to design, compact, light, flexible and readily adapted to the various production needs.

I claim:

1. Process for the continuous electrolytic treatment of metal bodies which ensures control and constancy of fluid dynamics conditions throughout the whole process, comprising the following operations in cooperation:

passing the metal body to be treated through at least one treatment unit, said unit comprising a first and a second adjacent, identical vertical electrolytic cells each with a vertical conduit within whose walls are housed the electrodes and each with an upper and a lower distribution chamber; said metal body being deflected downwards by an upper conductor roll, passing vertically downwards through the first cell and being then deflected upwards by a lower conductor roll and passing upwardly through said second cell where it is again deflected by an upper conductor roll, none of the conductor rolls being immersed in the electrolyte, said vertical cells terminating above said lower roll with seals housed in each chamber, such as to permit passage of the metal body as well as of leakby flows;

ensuring a controllable flow-rate of electrolyte in each cell by feeding a main known stream and at the same time introducing additional known streams to compensate for electrolyte lost by leakby, thus maintaining the electrolyte level constant in each upper chamber;

applying a difference of potentials between the metal body to be treated and the electrodes.

2. Process according to claim 1 in which the electrolytic cells are formed by vertical conduits having a rectangular section, closed at the sides, in which the electrodes are housed in two of the walls of said conduits.

3. Process according to claim 1 in which the electrolytic cells are formed by vertical conduits having a round section.

4. Process according to claim 1 in which all the deflection rolls, including the lower one, are used as current conductors.

5. Process according to claim 1 in which the main stream of electrolyte is fed to the lower chamber of the first cell, is forced to pass upwards through the cell conduit to the corresponding upper chamber which is in communication with the upper chamber of the second cell and then descends by gravity through the conduit of said second cell to the corresponding lower chamber from which it flows out.

6. Process according to claim 1 in which the main stream of electrolyte is fed to the upper chamber of the first cell and is forced to pass into the upper chamber of the second by means of a pump which transfers it from the lower chamber of the first cell to the lower chamber of the second, forcing it to pass through the corresponding conduits.

7. Process according to claim 1 in which main streams of electrolyte are fed separately to each cell of the treatment unit.

8. Device for the continuous electrolytic treatment of metal bodies comprising at least one treatment unit comprising two identical vertical electrolytic cells, in which:

the metal body to be continuously treated is deflected by an upper conductor roll, passess vertically downwards through the first cell, is deflected upwards by a lower conductor roll and passes through the second cell towards the top where it is diverted by another upper conductor roll, none of the conductor rolls being immersed in the electrolyte;

each electrolytic cell comprises a vertical conduit in the walls of which are housed electrodes and said conduit has an upper and a lower expansion chamber the latter terminating above the lower roll and housing seal systems which permit passage of the metal body to be treated;

each unit is provided with tanks collecting the leakby flows and with cooperating means to regulate the direction and rate of electrolyte flow independently in each cell.

9. Device according to claim 8 in which said cooperating means comprise valves for regulating electrolyte flow rates, pumps and flow-meters.

10. Device according to claim 8 in which the electrolytic cells consist of vertical conduits having a rectangular cross section, closed at the sides in which the electrodes are housed along two parallel faces of said conduits.

11. Device according to claim 8 in which the electrolytic cells consist of vertical conduits having a round cross-section.

12. Device according to claim 8 in which the deflection rolls are all used as current conductors.

13. Device according to claim 8 in which the lower distribution chambers are interconnected by means of a pump.

14. Device according to claim 8 in which the upper distribution chambers are interconnected by means of a valve.

15. Device according to claim 8 in which the upper distribution chambers are open and are provided with adjustable overflow weirs.

16. Device according to claim 8 in which the upper distribution chambers are replaced by a single common expansion chamber for the two cells of the unit.

17. Device according to claim 8 comprising a tank to collect leakby flows said tank being divided into two parts by a leak-proof divisor forming two separate chambers on the bottom of which are outlets where said flows coming from each lower chamber are collected separately and metered as they leave via the outlets.

18. Device according to claim 8 in which the electrolyte is fed into the first cell in an upwards direction and passes through the second cell in a downwards direction, while the metal body to be treated passes through the first cell in a downwards direction and through the second in an upwards direction.

19. Device according to claim 8 in which the electrolyte is fed into the second cell in an upwards direction and passes through the first cell in a downwards direction, while the metal body to be treated passes through the first cell in a downwards direction and through the second in an upwards direction.

20. Device according to claim 8 in which the electrolyte is fed into the first cell in a downwards direction and passes through the second cell in an upwards direction, while the metal body to be treated passes through the first cell in a downwards direction and through the second in an upwards direction.

21. Device according to claim 8 in which the electrolyte is fed into the second cell in a downwards direction and passes through the first cell in an upwards direction, while the metal body to be treated passes through the first cell in a downwards direction and through the second in an upwards direction.

22. Device according to claim 8 in which the first and second cells are fed simultaneously from above through their relevant upper distribution chambers with two distinct flows of electrolyte passing downwards in each cell, while the metal body to be treated passes downwards in the first cell and upwards in the second.

23. Device according to claim 8 in which the first and second cells are fed simultaneously from the bottom through their relevant bottom distribution chambers with two distinct flows of electrolyte, creating upward flows in said cells, while the metal body to be treated passes downwards through the first cell and upwards through the second.

24. Device according to claim 8 in which the first cell is fed from the bottom and simultaneously the second cell is fed from the top with two distinct flows of electrolyte, creating an upward flow in said first cell and a downward one in the second cell, while the metal body to be treated passes downwards through the first cell and upwards through the second.

25. Device according to claim 8 in which the first cell is fed from the top and simultaneously the second cell is fed from the bottom with two distinct flows of electrolyte, creating a downward flow in said first cell and an upward one in the second, while the metal body to be treated passes downwards through the first cell and upwards through the second.

* * * * *